United States Patent [19]

Långgård et al.

[11] 4,365,482

[45] Dec. 28, 1982

[54] DEVICE AT HEATING OR COOLING UNIT

[76] Inventors: Sixten Långgård, Box 75, 736 00 Kungsör; Lennart Larsson, Agnevägen 9, 633 47 Eskilstuna, both of Sweden

[21] Appl. No.: 195,607

[22] PCT Filed: Aug. 17, 1979

[86] PCT No.: PCT/SE79/00174

§ 371 Date: Apr. 24, 1980

§ 102(e) Date: Apr. 24, 1980

[87] PCT Pub. No.: WO80/00491

PCT Pub. Date: Mar. 20, 1980

[30] Foreign Application Priority Data

Aug. 24, 1978 [SE] Sweden ..... 7808937

[51] Int. Cl.[3] ..... F25B 45/00

[52] U.S. Cl. ..... 62/149; 62/174; 62/230

[58] Field of Search ..... 62/230, 149, 174, 196 R, 62/196 C

[56] References Cited

U.S. PATENT DOCUMENTS

| | | | |
|---|---|---|---|
| 2,453,131 | 11/1948 | Hubbard | 62/230 X |
| 2,807,940 | 10/1957 | Urban | 62/149 |
| 2,938,362 | 5/1960 | Schwind | 62/230 |
| 2,951,350 | 9/1960 | Etherington et al. | 62/149 |
| 3,237,422 | 3/1966 | Pugh | 62/174 X |
| 3,736,763 | 6/1973 | Garland | 62/174 |

*Primary Examiner*—Albert J. Makay
*Assistant Examiner*—Harry Tanner
*Attorney, Agent, or Firm*—LeBlanc, Nolan, Shur & Nies

[57] ABSTRACT

A device at a heating or cooling unit such as, for example, a heat pump where the energy carrier is a substance, the volume of which varies substantially with the temperature, for example freon.

At such a unit, which comprises condenser (1,2), evaporator (1,2) and compressor (3), and where the compressor is driven by an electric motor (18), according to the invention a tank (21) is provided to contain said substance (22) and is connected to the suction side (19) and, respectively, pressure side (20) of the compressor (3) by two respective conduits (23,24), each of which is provided with an electrically controlled valve (25,26) for closing and, respectively, opening the conduit in question.

A control circuit (27) is provided to sense the load of the motor (18) and in response to said load to actuate said valves (25,26) so as thereby to control the filling and draining of said substance (22) to and, respectively, from the system, from and, respectively, to said tank (21) in order to have in the system such an amount of said substance that a predetermined pressure is maintained in the system in order thereby to obtain a good efficiency degree of the unit at different temperatures of the same.

2 Claims, 2 Drawing Figures

DEVICE AT HEATING OR COOLING UNIT

This invention relates to a device at a heating or cooling unit, more precisely at a unit containing as energy carrier a substance, the volume of which varies much with the temperature, for example freon.

At known apparatuses, such as heat pumps or the like, a closed circuit is established which contains a certain amount of freon. Freon gas has the property that at decreasing temperature its pressure decreases substantially.

A heat pump for house heating purposes, for example, comprises an outdoor evaporator and an indoor condenser, where the freon gas is forced to be evaporated outdoors due to a large pressure drop occurring when the gas enters the evaporator. At a low outdoor temperature the gas pressure of freon, and also its volume are reduced, which results in a lower freon pressure in the entire system. The system generally is provided with a compressor, which produces a certain pressure increase. Thereby, a lower freon pressure even after the compressor is obtained, and the pressure drop obtainable at the inlet to the evaporator is not sufficiently great to bring about a good efficiency degree of the installation.

For this reason, known installations are designed to operate within a certain temperature interval, below which the efficiency degree is unacceptably low.

The present invention solves this problem entirely and offers a device rendering it possible for an installation to be utilized from normal to very low temperatures with a satisfactorily high efficiency degree.

The present invention, thus, relates to a device at a heating or cooling unit such as, for example, a heat pump or the like where the energy carrier is a substance, the volume of which varies considerably with the temperature, such as freon, which unit comprises a compressor, a condenser, an expansion valve and subsequent evaporator as well as conduits for advancing said substance in said system, and where the compressor is driven by an electric motor.

The invention is characterized in that a tank is provided to contain said substance and connected to the suction side and, respectively, pressure side of the compressor by two respective conduits, each of which is provided with an electrically controlled valve for closing and, respectively, opening the conduit in question, and that a control circuit is provided to sense the load of the motor and in response thereto to transmit a signal to said valves in order thereby to control in a predetermined way the filling and draining of said substance into, and, respectively, from the system, from and, respectively, to said tank and thereby to have in the system such an amount of substance, that a predetermined pressure in the system is maintained, whereby a good efficiency degree of the unit at different temperatures of the same is obtained.

Figure 1:
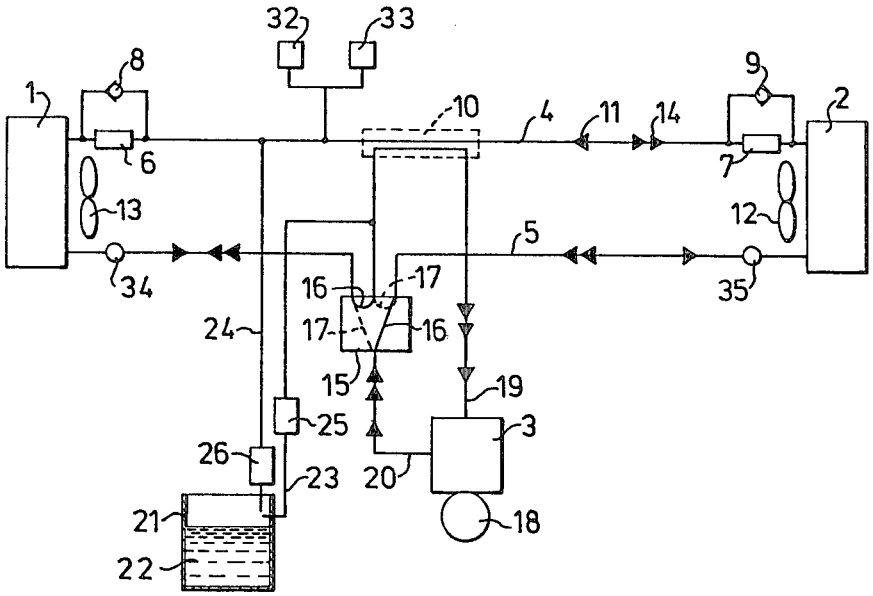
Figure 2:
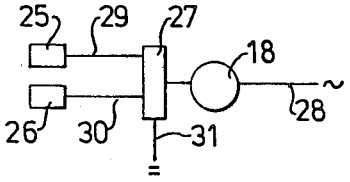

The invention is described in detail in the following, with reference to the accompanying drawing, in which:

FIG. 1 schematically shows a heat pump installation as example of the application of the invention, and FIG. 2 schematically shows a control device according to the invention.

In the following, first a known installation is described whereafter the present invention applied thereon is set forth.

FIG. 1 shows an evaporator 1,2, a condenser 1,2 and a compressor 3 for advancing freon in pipes 4,5 between the evaporator and the condenser. At the evaporator 1 and, respectively, condenser 2 further an expansion valve 6,7 is located. In parallel with every expansion valve 6,7 a check valve 8,9 is provided. A heat exchanger 10 preferably is provided to evaporate possible liquid freon, before it is sucked into the compressor, by means of the condensed freon gas coming from the condenser.

In FIG. 1, single arrows 11 indicate the flow direction in cases when the installation is intended to heat a house, for example. A condenser 2 is located indoors, and an evaporator 1 is located outdoors. Fans 12,13 schematically shown drive air streams through the condenser and, evaporator, respectively. Double arrows 14 indicate the flow direction in cases of inverted relationship, viz. when the installation is intended to cool the house relative to its surrounding, in which case 1 designates the condenser and 2 designates the evaporator. A multipath valve 15 is provided to direct the flow in the said two directions.

In FIG. 1, the paths in the valve 15 indicated by fully drawn lines 16 are linked to the flow direction indicated by a single arrow 11, and the ones indicated by dashed lines 17 are linked to the flow direction indicated by a double arrow 14.

The system described above operates schematically in the way described as follows.

The compressor 3 is driven by a motor 18. During the running of the motor 18 the compressor 3 sucks in freon gas on the suction side 19, compresses the gas and pumps it out on the pressure side 20. The gas is passed thereafter through the condenser 2 where it is condensed, and heat is given off to the ambient air. The condensed gas passes through the check valve 9 at the condenser 2 and is thereafter pressed by pressure delivered by the compressor 3 through the expansion valve 6 into the evaporator 1. The pressure drop over the expansion valve must be relatively great. The check valve 8 at the evaporator does not permit the condensed gas to pass therethrough. In the evaporator 1 the gas is evaporated and thereby absorbs heat energy from the evaporator and its surrounding. The evaporated gas is thereafter led via the heat exchanger 10 to the suction side 19 of the compressor 3, in order to be compressed and again to give off heat in the condenser 2.

The expansion valves 6,7 preferably are controllable in known manner by temperature-sensing members 34,35. The device hitherto described, which is known, is according to the present invention provided with a closed tank 21 or the like containing freon 22. To the tank 21 a conduit 23 is connected from the suction side 19 of the compressor 3 as well as a conduit 24 from the pressure side 20 of the compressor 3. The respective expansion valve 6,7 has been considered to be the border between pressure and suction side.

On the conduit 23 from the suction side of the compressor an electromagnetically controlled valve 25 for closing or opening the conduit is provided. Such a valve 26 is also located on the conduit 24 from the pressure side of the compressor.

At cold weather outdoors, for example, the freon gas is cooled. Consequently its volume and thereby the pressure in the entire system decreases. For different reasons, the compressors in the systems here referred to are so designed and driven that they generally yield a certain definite pressure increase. The lower pressure thus obtained, as mentioned in the introductory portion, results in a lower efficiency degree, due to a lower pressure drop over the expansion valve and thereby a lower degree of evaporation with resulting lower heat absorption.

According to the present invention, the working current of the motor 18 is sensed by a control circuit 27, for example in an inductive or resistive way, in one or several phases. The numeral 28 designates the current supply line or lines of the motor. The circuit 27 is capable to transmit a signal, preferably D.C., via a conductor 29 to one 25 of the said electromagnetic valves 25,26, when the working current of the motor falls below a certain value, and to transmit a signal via a conductor 30 to the second one 26 of the said electromagnetic valves when the working current of the motor exceeds a certain value. The current supply of the circuit 27 is designated by 31. The circuit 27 may be of a suitable known design, and preferably it is capable to transmit said signals only when the motor is running.

Said circuit 27 in combination with the valves 25,26 has the function as follows. Decreasing freon pressure in the system as mentioned is caused by the fact that the system is cooled. The working current of the motor then drops due to the lower load of the motor. When the working current has dropped below a certain predetermined value, which is related to a certain freon pressure, the circuit 27 transmits a signal to the valve 25 on the suction side 19 of the compressor whereby the valve 25 opens. The compressor at this sucks freon from the tank into the system. When the working current, and the freon pressure related thereto have increased to a predetermined level corresponding to desired operation, the circuit 27 breaks the signal to the valve 25, which thereby is closed.

In the normal case, thus, both valves 25,26 are closed.

When on the other hand the pressure in the system increases, due to the fact that the system is heated, also the working current of the motor increases. When the current has increased to a certain predetermined value, which is related to a certain freon pressure, the circuit 27 transmits a signal to the valve 26 on the pressure side 20 of the compressor, whereby the valve 26 opens and freon is drained from the system to the tank 21. When the working current of the motor has dropped to said certain level corresponding to desired operation, the circuit 27 breaks the signal to the valve 26 whereby the valve is closed. It can be mentioned as an example that the lower working current related to the lower pressure level, and the higher working current related to the higher pressure level can be about 1–20% lower and, respectively, higher than the desired working current related to the desired operation pressure, preferably about 5–10%.

When the opposite flow direction indicated by double arrows 14 is to be used, the multipath valve 15 merely is adjusted in the aforedescribed way whereafter the function of the installation in respect of filling and draining of freon is the same.

For safety reasons, an installation in which the present invention is utilized, preferably is provided with two pressure transmitters 32,33 on the pressure side of the compressor. One pressure transmitter 32 transmits a signal when the pressure in the system exceeds the highest desired or permissible pressure, and the second transmitter transmits a signal at a corresponding low pressure. According to one embodiment, said pressure transmitters 32,33 can be connected electrically to the control circuit 27, and signals from the pressure transmitters are utilized as the upper and, respectively, lower limit for filling and, respectively, draining freon to and, respectively, from the system by the valves 25,26.

As example can be mentioned, that experiments have proved that a standard installation, in which the present invention is not utilized, at an outdoor temperature of +5° C. showed a so-called coefficient of performance equal to 1, i.e. no heat yield. The same standard installation, with the present invention applied thereto, showed a coefficient of performance equal to 2.5 at −10° C. These values prove that by the present invention a high increase in efficiency degree can be obtained.

It is, thus, fully clear that the present invention offers the great advantage, that an installation of the kind here referred to can operate at the desired operation pressure, irrespective of the temperature of the system, and that thereby a good degree of efficiency always can be obtained.

In the above description only installations with freon have been dealt with. The invention, of course, can be applied to all installations of the kind concerned, such as heat pumps, cooling units etc., which as energy carrying medium use a substance, the volume of which varies with the temperature to such an extent, that the system must be filled or drained, so that the efficiency degree of the installation is satisfactory under the prevailing circumstances.

The present invention must not be regarded restricted to the embodiments described above, but can be varied within the scope of the attached claims. The sensing of the motor load, for example, can be effected in a different way.

We claim:

1. A device in a heating or cooling system, such as, a heat pump, wherein the energy carrier is a substance, the volume of which varies substantially with the temperature, for example freon, which system constitutes a closed total system comprising: an active system portion of said closed system including a compressor, a condenser, an expansion valve, a subsequent evaporator and appropriate conduits for advancing said substance in said active system; a closed tank, connected to said active system portion, for containing said substance, said tank being connected respectively to the suction side and pressure side of the compressor by two respective conduits, each of which is provided with an electrically controlled valve for closing and opening the conduit in question, wherein the compressor is driven by an electric motor and wherein a control circuit is provided to sense the load of the motor, characterized in that: said control circuit is adapted in a way known per se, to sense the working current in one or several phases and, in response to said working current, is adapted to transmit a signal to that said valve which is located on the suction side of the compressor to cause said valve to open when the working current has dropped below a predetermined value related to a certain pressure in the system whereby filling of the substance into the active system from said tank is effected, and is adapted to transmit a signal to that said valve located on the pressure side of the compressor to cause the associated valve to open when the working current has increased above a certain predetermined value related to a certain pressure in the active system whereby draining of the substance from the active system into said tank is effected, in order to vary the amount of said substance in the active system so that a predetermined pressure, as well as normal working conditions for the compressor, is maintained in the active system to obtain a good efficiency of the unit at different temperatures thereof.

2. A device as defined in claim 1, characterized in that the lower predetermined value and, respectively, the higher predetermined value are 1–20% lower and higher, respectively, than a normal working current, and preferably are 5–10% lower and higher, respectively.

* * * * *